US005762111A

United States Patent [19]

Frischknecht

[11] Patent Number: 5,762,111

[45] Date of Patent: Jun. 9, 1998

[54] ROLLER-TYPE WEFT THREAD CUTTING APPARATUS

[75] Inventor: Martin Frischknecht, Bubikon, Switzerland

[73] Assignee: Sulzer Rueti AG, Rueti, Switzerland

[21] Appl. No.: 723,664

[22] Filed: Oct. 4, 1996

[30] Foreign Application Priority Data

Oct. 6, 1995 [CH] Switzerland ..... 02833/95

[51] Int. Cl.[6] ..... D03D 49/70

[52] U.S. Cl. ..... 139/302; 83/430; 83/500; 83/937

[58] Field of Search ..... 139/302, 303; 83/430, 500, 504, 501, 491, 514, 476, 937, 469, 582, 338, 348

[56] References Cited

U.S. PATENT DOCUMENTS 1,599,037 9/1926 Brown ..... 139/302
4,498,504 2/1985 Allen et al. ..... 139/302
5,575,314 11/1996 Capitanio et al. ..... 139/302

FOREIGN PATENT DOCUMENTS 1 352 200 1/1964 France ..... 139/302
1 535 282 12/1970 Germany ..... 139/302

*Primary Examiner*—Andy Falik
*Attorney, Agent, or Firm*—Townsend and Townsend and Crew LLP

[57] ABSTRACT

A weft cutting apparatus contains a first and a second cutting blade as well as a drive element which is connected to the second cutting blade and can be driven by the cloth directly. The cutting process is thereby synchronized with the speed of the cloth. The apparatus is arranged in a weaving machine in the region of the path of the cloth, wherein the apparatus can be placed at a suitable position independent of the weaving machine drive.

21 Claims, 4 Drawing Sheets

ROLLER-TYPE WEFT THREAD CUTTING APPARATUS

BACKGROUND OF THE INVENTION

The invention relates to an apparatus for cutting weft threads at a cloth edge as well as to a weaving machine with an apparatus of this kind.

Apparatus for cutting weft threads have been used in weaving machines. For instance, U.S. Pat. No. 5,575,314 to Capitanio et al. discloses a weft cutter for an air loom in which a movable blade is hinged to the ram of a pneumatic cylinder. The cylinder is pneumatically fed through a solenoid valve that is adapted to be controlled from a loom console. To cut the weft threads, the drive system oscillates a movable blade with respect to a stationary blade back and forth between a resting position and an active position. The cutting is controlled from the loom console as a function of the type of weft to be cut.

U.S. Pat. No. 1,599,037 to Brown discloses a thread cutting temple that includes toothed forward roll and rear roll of the cylindrical type provided with pin points. The forward roll is journalled on a spindle and the rear roll is journalled on another spindle. The cutting mechanism includes a circular knife blade and a generally rectangular stationary knife blade disposed inside a slot. The circular knife blade is centrally apertured to fit over the spindle and is supported to rotate with the rear roll. The stationary knife blade has an aperture that also fits over the spindle but is of such a size that one of its edges abuts the edge wall of the slot to prevent rotation. At a rear edge of the stationary knife blade is a notch, the lower edge of which or both the upper and lower edges of which form cutting edges to cooperate with the teeth of the circular knife blade.

SUMMARY OF THE INVENTION

The object of the invention is to provide an apparatus for cutting the weft threads at a cloth edge which is driven independently of the weaving machine drive.

This object is satisfied in accordance with the invention by a drive element for the second cutter blade which can be driven directly by the cloth or by a fluid.

The advantages of the invention are essentially to be teen in the fact that the cutting process is synchronized with the speed of the cloth when driven directly by the cloth in that the cutting process can be matched to the speed of the cloth in a simple manner, and in that the apparatus can be arranged in the region of the path of the cloth in the weaving machine independently of the weaving machine drive.

DESCRIPTION OF THE PREFERRED EMBODIMENTS

Reference is made to FIGS. 1 to 6, which show a first, a second and a third embodiment of the apparatus being discussed here. These embodiments have the same basic construction and their difference is substantially in the execution of the drive element. The apparatus contains a first and a second cutting blade 1, 2, a drive element 3, 4, 31 for the second cutting blade 2, and a bearing block 5.

Figure 1:
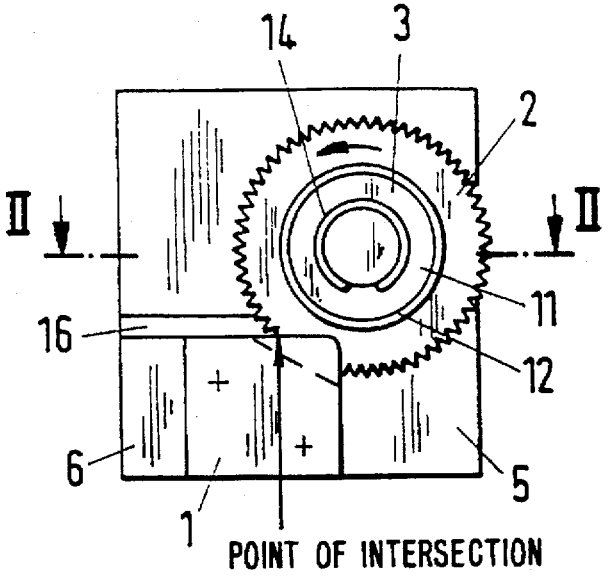
FIG. 1 is a front view of a first embodiment of an apparatus in accordance with the invention.

As shown in FIG. 1, the first cutting blade is shaped in a plate-like manner and secured to a support 6. The support 6 is constructed integrally as a single piece with the bearing block 5 or as a spacing part. The second cutting blade 2 has cutting teeth. The second cutting blade 2 can also have a continuous cutting edge (not shown).

Figure 2:
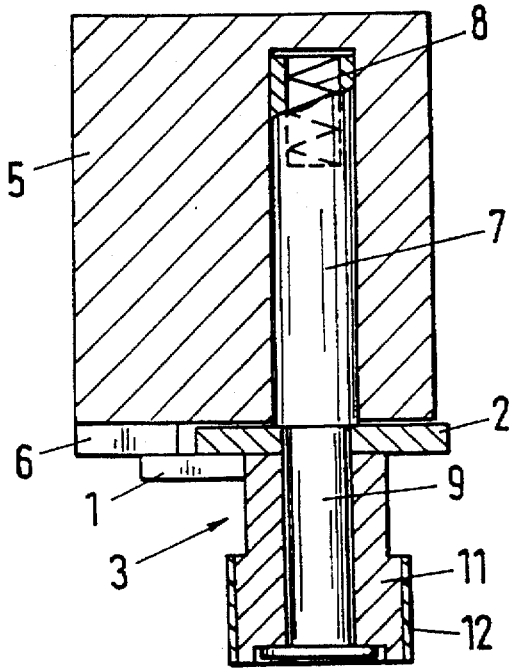
FIG. 2 is a partial cross-sectional view along the line II—II in FIG. 1.

As shown in FIG. 2, an axle 7 is provided on which the cutting blade 2 is supported, with the cutting blade 2 being held on the axle in a stable position by a non-illustrated guide, e.g. a tongue and groove or the like. The axle 7 is supported in the bearing block 5 and has a blind bore at the inwardly disposed end. A compression spring 8 is provided at this blind bore in order to produce a bias force for urging the second cutting blade 2 towards the first cutting blade 1. The axle 7 has a section 9 with a smaller outer diameter on which the second cutting blade 2 and the drive element 3, 4, 31 are rotatably supported, with the second cutting blade 2 being securely connected to the drive element 3, 4, 31.

A drive element 3 which has a substantially cylindrical body 11 and a contact surface 12 made of an elastic material, e.g. rubber or the like, is provided in the embodiment of FIG. 1. At least one ring-shaped member can be used instead of the contact surface in a different embodiment (not shown).

Figure 3:
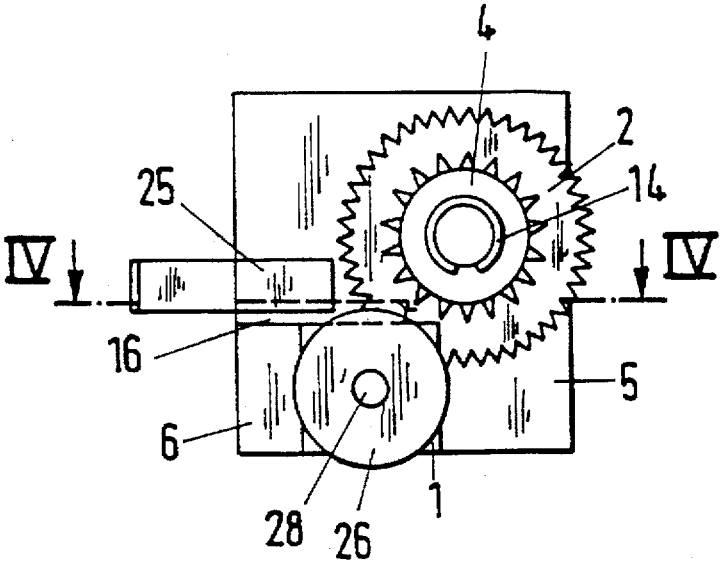
FIG. 3 is a front view of a second embodiment of an apparatus in accordance with the invention.
Figure 4:
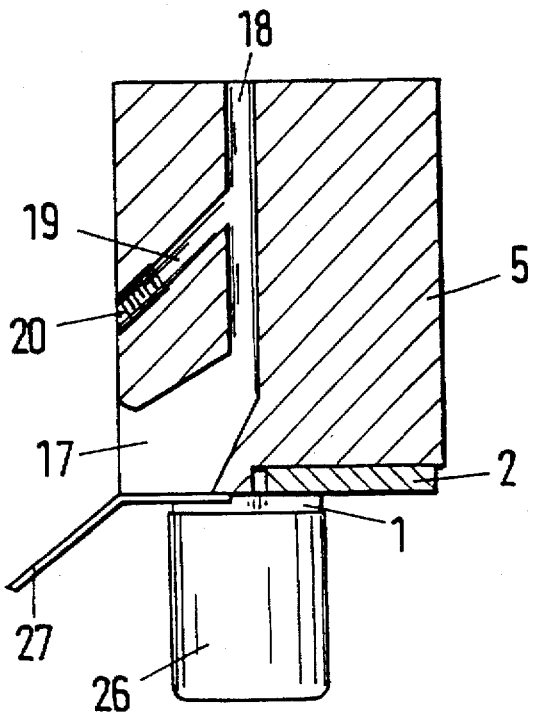
FIG. 4 is a partial cross-sectional view along the line IV—IV in FIG. 3.

In the embodiment of FIG. 3 the drive element is a spiked wheel 4. The drive elements 3, 4 in FIGS. 1 and 2 are held on the axle 7 by means of a securing ring 14.

A recess 16 which will be discussed with reference to FIG. 3 is formed in the bearing block 5. This recess 16 forms a vacuum extraction chamber whose mode of functioning will be described later. The recess 16 includes of an intake section 17, a discharge channel 18 into which the intake channel 17 opens, and a channel 19 for supplying compressed air, which opens into the discharge channel 18. The channel 19 is provided with an inner thread in order to lock in a non-illustrated connection line leading to a source of compressed air. The contour of the recess 16 is configured to match the required flow conditions. The apparatus is intended to cut off the weft threads at the cloth edge of a cloth. In order to fulfill this task it is advantageous if the cloth is guided by an apparatus. Such an apparatus is illustrated in FIG. 3.

The apparatus comprises a holding-down member 25 and a support member 26. The holding-down member 25 includes a strip bent at an angle which is fastened to the bearing block 5 in such a manner that one limb 27 projects away from the bearing block 5. Instead of a strip a spring bar or spring wire can be used. The support member 26 has a cylindrical body. The body is supported on a bar 28 which is secured to the bearing block 5. It is advantageous for the body to be securely connected to the bar 28. It can be advantageous for certain kinds of cloth to use a second support member (not illustrated). In this case the first and second support members 26 are arranged parallel to and spaced with respect to one another on the bearing block 5 in such a manner that the cutting blades are arranged to be mirror imaged with respect to the point of intersection formed by the first outer blade edge of the first cutting blade 1 and the second outer blade edge of second cutting blade 2. A vacuum extraction apparatus (not shown) can be connected to the discharge channel 18.

Figure 6:
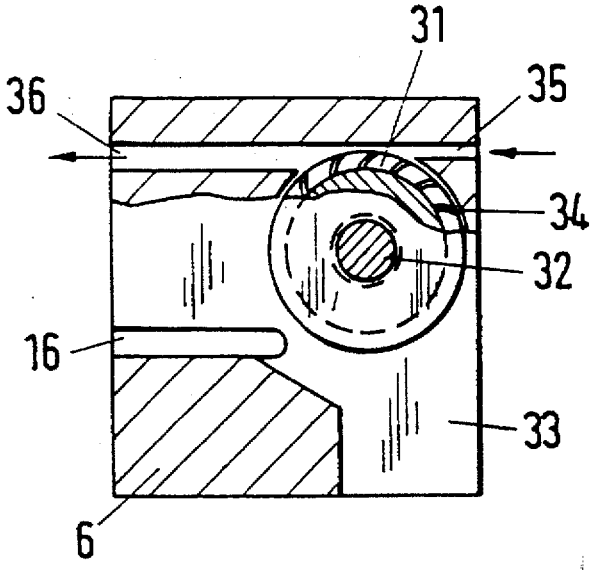
FIG. 6 is a partial cross-sectional view along the line VI—VI in FIG. 5.
Figure 5:
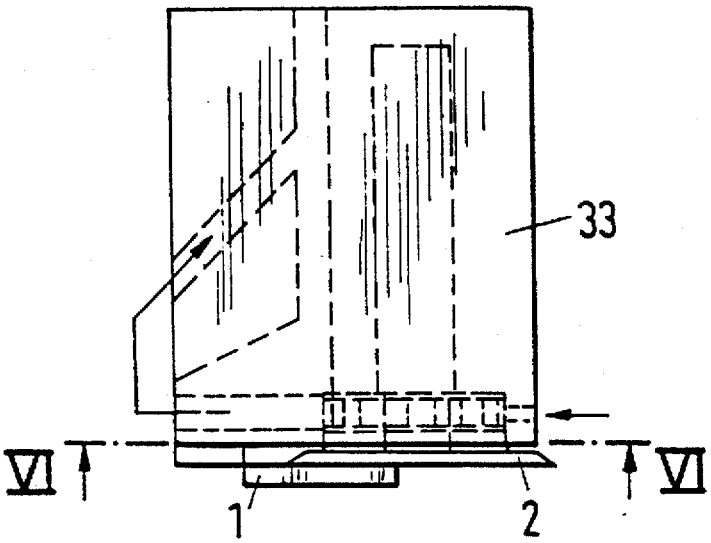
FIG. 5 is a plan view of a third embodiment of an apparatus in accordance with the invention.

The apparatus of FIGS. 5 and 6 differs from the apparatuses of FIGS. 1 to 4 by the type of drive of the second cutting blade 2. For this reason the following description is restricted to the differences. The..apparatus has a turbine rotor 31 which is connected to the second cutting blade 2. The turbine rotor 31 and the second cutting blade 2 are rotatably journalled on a axle 32 which is displaceably arranged in the axial direction in a bearing block 33. A recess 34 is formed in the bearing block 33 for the turbine rotor 31. The recess 34 adjoins a channel which is subdivided into a section 35 for the incoming air and a section 36 for the outgoing air. The contour and the cross-section of the channel are determined by the required flow conditions. The section 36 is connected via a non-illustrated tube-like member, e.g. a tube, a hose, etc., to the channel 19 for supplying the air.

Figure 7:
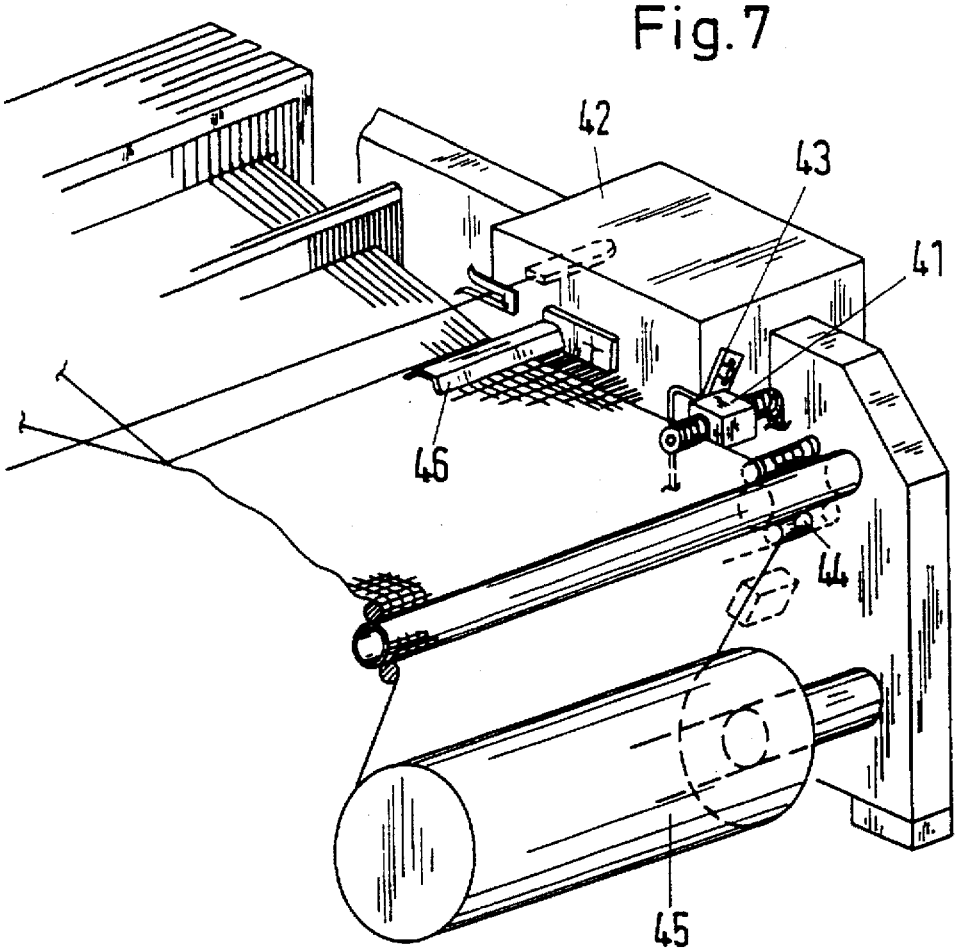
FIG. 7 is a section of a weaving machine with the apparatus.

FIG. 7 shows a projectile weaving machine with an apparatus for cutting the weft threads. The construction of weaving machines of this kind is known merely to illustrate the application of the apparatus of this invention. As shown in FIG. 7, the cutting apparatus 41 is fastened as a constructional unit to the receiver or catcher unit 42 for the projectiles or shuttles, for which purpose a holder 43 is provided. The holder 43 has means (not shown) for adjusting the apparatus with respect to the path of the cloth. The apparatus can be arranged at a different position along the path of the cloth, e.g. in the region between the cloth take-up apparatus 44 and the cloth beam 45, after the temple 46 in the direction A of the cloth, or after the cloth take-up apparatus 44 in the direction A. On the other hand the apparatus can be provided at the insertion side and/or the receiving side of the weaving machine.

Figure 8:
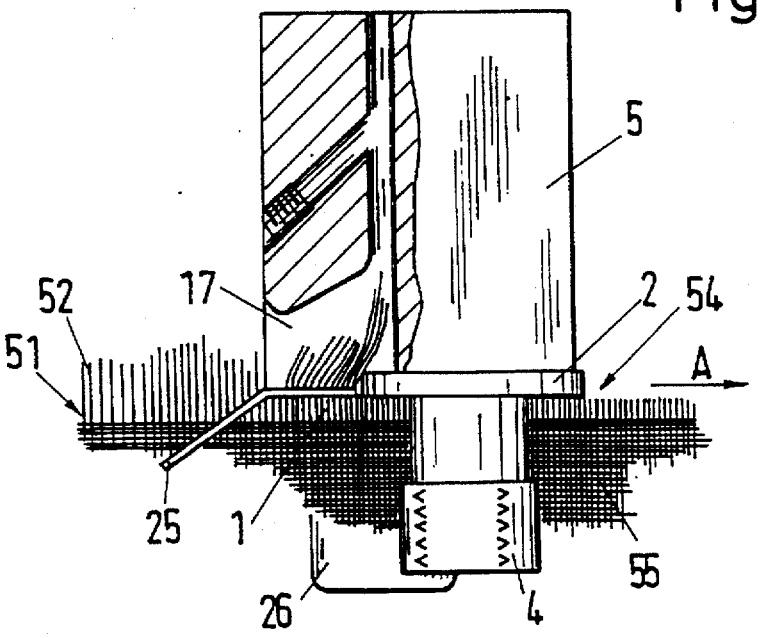
FIG. 8 is partial cross-sectional view of an apparatus in accordance with the invention during operation.

As shown in FIG. 8 the weft thread ends 52 which project beyond the cloth edge 51 are severed by the apparatus described so that a so-called fringed edge 54 is produced on the cloth 55. In order to sever the weft threads 52 it is advantageous if the weft thread ends are straightened out prior to their arrival at the cutting position. For this purpose the cloth 55 is guided by the holding-down member 25 in such a manner that the weft thread ends pass into the intake section 17 of the suction chamber and are stretched as a result of the suction effect. For the embodiment shown in FIGS. 3 and 4, the spiked wheel 4 is set rotating by the cloth 55 being drawn in the direction A and drives the second cutting blade 2. To improve the cutting effect the cloth 55 is led over at least one support member 26 in order to orient the cloth cutting edge 54 to the cutting location and simultaneously to prevent a deflection of the cloth edge with respect to the cutting location.

It is understood that the embodiments of FIGS. 1 and 2 and of FIGS. 5 and 6 can be similarly used to cut the weft threads 52 at a speed synchronized with the speed of the cloth. While the second cutting blade 2 is driven directly by the cloth 55 via spikes in the embodiment of FIGS. 3 and 4 and via frictional contact in the embodiment of FIGS. 1 and 2, it is driven by a fluid in the embodiment of FIGS. 5 and 6.

The apparatus contains a first and a second cutting blade 1, 2 as well as a drive element 4 which is connected to the second cutting blade 2 and can be driven by the cloth 55 directly. The cutting process is thereby synchronized with the speed of the cloth.

The apparatus is arranged in a weaving machine in the region of the path of the cloth, wherein the apparatus can be placed at a suitable position independent of the weaving machine drive.

What is claimed is:

1. An apparatus for cutting weft threads at a cloth edge of a cloth, said apparatus comprising a first cutting blade having a first outer blade edge, a second cutting blade, and a drive element coupled to the second cutting blade for moving the second cutting blade relative to the first cutting blade to sever the weft threads at the cloth edge at the first outer blade edge at a point of intersection formed between the first and second cutting blades, wherein the second cutting blade can be driven directly by the cloth.

2. An apparatus in accordance with claim 1 further comprising a bearing block for supporting the drive element in a fixed spatial position.

3. An apparatus in accordance with claim 2 wherein the first cutting blade is supported by the bearing block and the second cutting blade is kinematically connected to the drive element.

4. An apparatus in accordance with claim 2 wherein the first cutting blade is fastened to or rotatably supported by the bearing block.

5. An apparatus in accordance with claim 2 further comprising an axle which is axially displaceably arranged in the bearing block, with the drive element and the second cutting blade being rotatably supported by the axle.

6. An apparatus for cutting weft threads at a cloth edge of a cloth, said apparatus comprising a first cutting blade having a first outer blade edge, a second cutting blade, and a drive element coupled to the second cutting blade for moving the second cutting blade relative to the first cutting blade to sever the weft threads at the cloth edge at the first outer blade edge, wherein the second cutting blade can be driven directly by the cloth and the drive element comprises a spiked wheel for engaging into the cloth.

7. An apparatus for cutting weft threads at a cloth edge of a cloth, said apparatus comprising a first cutting blade having a first outer blade edge, a second cutting blade, and a drive element coupled to the second cutting blade for moving the second cutting blade relative to the first cutting blade to sever the weft threads at the cloth edge at the first outer blade edge, wherein the second cutting blade can be driven directly by the cloth and the drive element comprises a roller body and an elastic means disposed on the outer surface on the roller body for coming into frictional contact with the cloth.

8. A weaving machine comprising a machine chassis and a weft cutting apparatus for cutting weft threads at a cloth edge of a cloth, the weft cutting apparatus including a first cutting blade having a first outer blade edge, a second cutting blade, and a drive element coupled to the second cutting blade for moving the second cutting blade relative to the first cutting blade to sever the weft threads at the cloth edge at the first outer blade edge, wherein the second cutting blade can be driven directly by the cloth, the weft cutting apparatus being fastened in the region of the path of the cloth to the machine chassis or to a member connected to the machine chassis.

9. A weaving machine in accordance with claim 8 further comprising a temple, the weft cutting apparatus being placed after the temple in the direction of motion of the cloth.

10. A weaving machine in accordance with claim 8 further comprising a cloth take-up apparatus, the weft cutting apparatus being placed after the cloth take-up apparatus in the direction of motion of the cloth.

11. An apparatus for cutting weft threads at a cloth edge of a cloth, said apparatus comprising:

a first cutting blade;

a second cutting blade; and a drive element coupled to the second cutting blade for moving the second cutting blade relative to the first cutting blade to sever the weft threads at the cloth edge, the drive element including a turbine rotor which can be driven by means of compressed air.

12. An apparatus for cutting weft threads at a cloth edge of a cloth, said apparatus comprising:

a first cutting blade;

a second cutting blade;

a bearing block;

a drive element coupled to the second cutting blade for moving the second cutting blade relative to the first cutting blade to sever the weft threads at the cloth edge, the drive element being mounted on the bearing block; and a holding-down member supported by the bearing block for leading the cloth to a point of intersection formed by the first cutting blade and second cutting blade.

13. An apparatus for cutting weft threads at a cloth edge of a cloth, said apparatus comprising:

a first cutting blade;

a second cutting blade;

a bearing block;

a drive element coupled to the second cutting blade for moving the second cutting blade relative to the first cutting blade to sever the weft threads at the cloth edge, the drive element being mounted on said bearing block; and a support member supported by the bearing block for supporting the cloth ahead of a point of intersection formed by the first cutting blade and second cutting blade.

14. The apparatus of claim 13, further comprising a holding-down member supported by the bearing block for leading the cloth to the point of intersection formed by the first cutting blade and second cutting blade.

15. The apparatus of claim 14, wherein the holding-down member and/or the support member is supported fixedly or rotatably by the bearing block.

16. An apparatus for cutting weft threads at a cloth edge of a cloth, said apparatus comprising:

a first cutting blade;

a second cutting blade movable relative to the first cutting blade to sever weft threads at the cloth edge;

a bearing block having a vacuum extraction channel for conveying away severed weft thread ends; and a drive element for the second cutting blade, the drive element being mounted on the bearing block.

17. An apparatus for cutting weft threads at a cloth edge of a cloth, said apparatus comprising:

a first cutting blade;

a second cutting blade;

a drive element coupled to the second cutting blade for moving the second cutting blade relative to the first cutting blade to sever weft threads at the cloth edge; and a bearing block having a vacuum extraction channel for conveying away severed weft thread ends, the drive element being mounted on the bearing block, wherein the bearing block includes a channel for supplying compressed air, the channel opening into a recess to cause an injector effect.

18. The apparatus of claim 17, further comprising means provided at the channel to connect the channel to a suction device.

19. The apparatus of claim 18, wherein the drive element comprises a turbine rotor which can be driven by means of compressed air.

20. The apparatus of claim 19, wherein the turbine rotor includes blades that project into the channel.

21. An apparatus for cutting weft threads at a cloth edge of a cloth, said apparatus comprising:

a first cutting blade;

a second cutting blade;

a drive element coupled to the second cutting blade for moving the second cutting blade relative to the first cutting blade to sever weft threads at the cloth edge; and a bearing block having a vacuum extraction channel for conveying away severed weft thread ends, the drive element being mounted on the bearing block, wherein the drive element comprises a spiked wheel which engages into the cloth.

* * * * *